US011600221B2

(12) United States Patent
Wu et al.

(10) Patent No.: US 11,600,221 B2
(45) **Date of Patent: *Mar. 7, 2023**

(54) DISPLAY APPARATUS

(71) Applicant: Au Optronics Corporation, Hsinchu (TW)

(72) Inventors: Shang-Jie Wu, Hsinchu (TW); Yu-Chieh Kuo, Hsinchu (TW); He-Yi Cheng, Hsinchu (TW); Che-Chia Chang, Hsinchu (TW); Yi-Jung Chen, Hsinchu (TW); Yi-Fan Chen, Hsinchu (TW); Yu-Hsun Chiu, Hsinchu (TW); Mei-Yi Li, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/519,586

(22) Filed: Nov. 5, 2021

(65) Prior Publication Data

US 2022/0059024 A1 Feb. 24, 2022

Related U.S. Application Data

(63) Continuation of application No. 16/813,754, filed on Mar. 10, 2020, now Pat. No. 11,170,699.

(30) Foreign Application Priority Data

Aug. 7, 2019 (TW) ..... 108128152

(51) Int. Cl.

| | |
|---|---|
| ***G09G 3/32*** | (2016.01) |
| ***G09G 3/20*** | (2006.01) |
| ***G09G 3/34*** | (2006.01) |

(52) U.S. Cl.

CPC ..... *G09G 3/32* (2013.01); *G09G 3/2074* (2013.01); *G09G 3/3413* (2013.01); *G09G 2310/0267* (2013.01); *G09G 2310/0275* (2013.01)

(58) Field of Classification Search

CPC ..... H01L 27/3262; H01L 27/124; H01L 27/3276; H01L 27/14636; H01L 51/5203;

(Continued)

(56) References Cited

U.S. PATENT DOCUMENTS

| | | | | |
|---|---|---|---|---|
| 10,643,577 | B2 * | 5/2020 | Nakamura | G09G 5/10 |
| 2017/0236466 | A1 * | 8/2017 | Spitzer | G09G 3/2085 345/560 |

(Continued)

*Primary Examiner* — Duc Q Dinh
(74) *Attorney, Agent, or Firm* — JCIPRNET

(57) ABSTRACT

A display apparatus includes a substrate and pixels disposed on the substrate. Each of the pixels includes sub-pixels. The substrate has an intermediate region and a peripheral region, where the peripheral region is located between an edge of the substrate and the intermediate region. The pixels include standard pixels disposed in the intermediate region and peripheral pixels disposed in the peripheral region. A color displayed by a sub-pixel of a standard pixel and a color displayed by a sub-pixel of a peripheral pixel are the same, and a distance between a second transistor of the sub-pixel of the standard pixel and a pad of the sub-pixel of the standard pixel is not equal to a distance between a second transistor of the sub-pixel of the peripheral pixel and a pad of the sub-pixel of the peripheral pixel.

4 Claims, 10 Drawing Sheets

(58) Field of Classification Search
CPC ..... H01L 27/14616; H01L 27/14609; H01L 27/14603; H01L 29/78645; H01L 27/1251; G06F 3/04164; G06F 3/0446; G09G 3/3233; G09G 3/32; G09G 2300/0413; G09G 2310/0232; G09G 3/3275; G09G 2300/0426; G09G 3/2074; G02F 1/13458; G02F 1/136277; G02F 2201/56
See application file for complete search history.

(56) References Cited

U.S. PATENT DOCUMENTS

2018/0190747 A1* 7/2018 Son ..... G06F 3/1423
2019/0005870 A1* 1/2019 Son ..... H01L 25/0753

* cited by examiner

DISPLAY APPARATUS

CROSS-REFERENCE TO RELATED APPLICATION

This application is a continuation application of and claims the priority benefit of U.S. application Ser. No. 16/813,754, filed on Mar. 10, 2020, now allowed, which claims the priority benefit of Taiwan application serial no. 108128152, filed on Aug. 7, 2019. The entirety of each of the above-mentioned patent applications is hereby incorporated by reference herein and made a part of this specification.

BACKGROUND

Technical Field

The disclosure relates to an electronic device, and more particularly, to a display apparatus.

Description of Related Art

A light-emitting diode display panel includes an active component substrate and a plurality of light-emitting diode devices transferred onto the active component substrate. Inheriting the characteristics of light-emitting diodes, the light-emitting diode display panel has advantages of power saving, high efficiency, high brightness, and fast response time. In addition, compared with an organic light-emitting diode display panel, the light-emitting diode display panel further has advantages of easy color adjustment, long light emission life, no image burn-in, etc. Therefore, the light-emitting diode display panel is considered as a display technology of the next generation. However, since the periphery of the light-emitting diode display panel is provided with a circuit that does not have a display function, it is not easy to realize a light-emitting diode display panel having a narrow border or even no border.

SUMMARY

The invention provides a display apparatus having a narrow border or even no border.

A display apparatus of the invention includes a substrate and a plurality of pixels disposed on the substrate. The substrate has an intermediate region and a peripheral region. The peripheral region is located between an edge of the substrate and the intermediate region. Each of the pixels includes a plurality of sub-pixels. Each of the sub-pixels includes a pixel driving circuit, a pad, and a light-emitting diode device. The pixel driving circuit includes a first transistor and a second transistor. The first transistor has a first terminal, a second terminal, and a control terminal. The second transistor has a first terminal, a second terminal, and a control terminal. The second terminal of the first transistor is electrically connected to the control terminal of the second transistor. The pad is electrically connected to the second terminal of the second transistor. The light-emitting diode device is electrically connected to the pad. The pixels include a plurality of standard pixels disposed in the intermediate region and a plurality of peripheral pixels disposed in the peripheral region. A distance A1 is present between the second transistor and the pad of each of the sub-pixels of each of the standard pixels. A distance A2 is present between the second transistor and the pad of each of the sub-pixels of each of the peripheral pixels. A sub-pixel of the standard pixel and a sub-pixel of the peripheral pixel are configured to display a same color, and the distance A1 of the sub-pixel of the standard pixel is not equal to the distance A2 of the sub-pixel of the peripheral pixel.

In an embodiment of the invention, the distance A2 of the sub-pixel of the peripheral pixel is greater than the distance A1 of the sub-pixel of the standard pixel.

In an embodiment of the invention, the distance A2 of the sub-pixel of the peripheral pixel is smaller than the distance A1 of the sub-pixel of the standard pixel.

In an embodiment of the invention, the sub-pixels of each of the pixels include a first sub-pixel configured to display a first color. The peripheral pixels include a first peripheral pixel and a second peripheral pixel. The first peripheral pixel is closer to the edge of the substrate than the second peripheral pixel, and the distance A2 of the first sub-pixel of the first peripheral pixel is greater than the distance A2 of the first sub-pixel of the second peripheral pixel.

In an embodiment of the invention, the sub-pixels of each of the pixels further include a second sub-pixel configured to display a second color, and the distance A2 of the second sub-pixel of the first peripheral pixel is greater than the distance A2 of the second sub-pixel of the second peripheral pixel.

In an embodiment of the invention, the sub-pixels of each of the pixels further include a third sub-pixel configured to display a third color, and the distance A2 of the third sub-pixel of the first peripheral pixel is smaller than the distance A2 of the third sub-pixel of the second peripheral pixel.

In an embodiment of the invention, relative positions of a plurality of pixel driving circuits and a plurality of pads of the sub-pixels of the standard pixel are different from relative positions of a plurality of pixel driving circuits and a plurality of pads of the sub-pixels of the peripheral pixel.

In an embodiment of the invention, the sub-pixels of each of the pixels include a first sub-pixel and a second sub-pixel, and the first sub-pixel and the second sub-pixel are respectively configured to display a first color and a second color. A first virtual straight line segment passes through a plurality of pads of the sub-pixels of the standard pixel, and a plurality of pixel driving circuits of the first sub-pixel and the second sub-pixel of the standard pixel are respectively disposed on two opposite sides of the first virtual straight line segment. A second virtual straight line segment passes through a plurality of pads of the sub-pixels of the peripheral pixel, and a plurality of pixel driving circuits of the first sub-pixel and the second sub-pixel of the peripheral pixel are disposed on a same side of the second virtual straight line segment.

In an embodiment of the invention, each of the sub-pixels further includes a data line, a scan line, and a power line. The first terminal of the first transistor is electrically connected to the data line, the control terminal of the first transistor is electrically connected to the scan line, and the first terminal of the second transistor is electrically connected to the power line. The standard pixel further includes a non-pixel driving circuit. The non-pixel driving circuit of the standard pixel is electrically connected to at least one of the data line, the scan line, the power line, the pixel driving circuit, the pad, and the light-emitting diode device of the sub-pixel of the standard pixel. The peripheral pixel further includes a non-pixel driving circuit. The non-pixel driving circuit of the peripheral pixel is electrically connected to at least one of the data line, the scan line, the power line, the pixel driving circuit, the pad, and the light-emitting diode device of the sub-pixel of the peripheral pixel. Relative positions of the non-pixel driving circuit of the standard pixel and the pad of the standard pixel are different from relative positions of the non-pixel driving circuit of the peripheral pixel and the pad of the peripheral pixel.

In an embodiment of the invention, the sub-pixels of each of the pixels include a first sub-pixel configured to display a first color. A plurality of pads of a plurality of first sub-pixels of the standard pixels are arranged at a first pitch in a direction. A plurality of pads of a plurality of first sub-pixels of the peripheral pixels are arranged at a second pitch in the direction. The first pitch is substantially equal to the second pitch.

To make the aforementioned more comprehensible, several embodiments accompanied with drawings are described in detail as follows.

DESCRIPTION OF THE EMBODIMENTS

Figure 1:
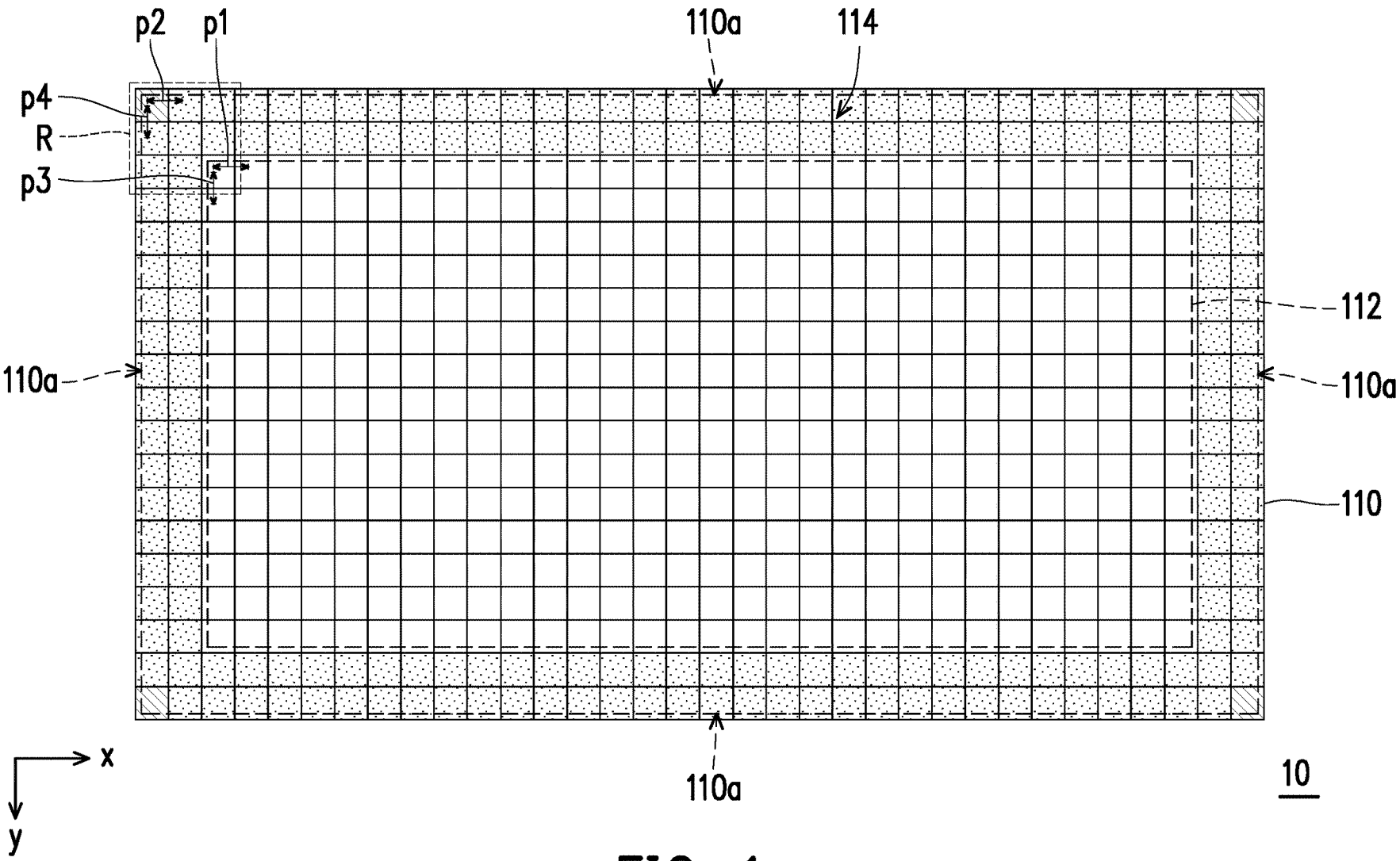
FIG. 1 is a schematic top view showing a display apparatus 10 according to an embodiment of the invention.

Reference will now be made in detail to exemplary embodiments provided in the disclosure, examples of which are illustrated in accompanying drawings. Wherever possible, identical reference numerals are used in the drawings and descriptions to refer to identical or similar parts.

It should be understood that when a device such as a layer, film, region or substrate is referred to as being "on" or "connected to" another device, it may be directly on or connected to another device, or intervening devices may also be present. In contrast, when a device is referred to as being "directly on" or "directly connected to" another device, there are no intervening devices present. As used herein, the term "connected" may refer to physical connection and/or electrical connection. Besides, if two devices are "electrically connected" or "coupled", it is possible that other devices are present between these two devices.

The term "about," "approximately," or "substantially" as used herein is inclusive of the stated value and a mean within an acceptable range of deviation for the particular value as determined by people having ordinary skill in the art, considering the measurement in question and the error associated with measurement of the particular quantity (i.e., the limitations of the measurement system). For example, "about" may mean within one or more standard deviations, for example, ±30%, ±20%, ±10%, or ±5% of the stated value. Moreover, a relatively acceptable range of deviation or standard deviation may be chosen for the term "about," "approximately," or "substantially" as used herein based on optical properties, etching properties or other properties, instead of applying one standard deviation across all the properties.

Unless otherwise defined, all terms (including technical and scientific terms) used herein have the same meaning as commonly understood by people of ordinary skill in the art. It will be further understood that terms, such as those defined in the commonly used dictionaries, should be interpreted as having a meaning that is consistent with their meaning in the context of the relevant art and the invention and will not be interpreted in an idealized or overly formal sense unless expressly so defined herein.

FIG. 1 is a schematic top view showing a display apparatus 10 according to an embodiment of the invention. FIG. 1 shows a substrate 110, and other components of the display apparatus 10 are omitted.

Figure 2:
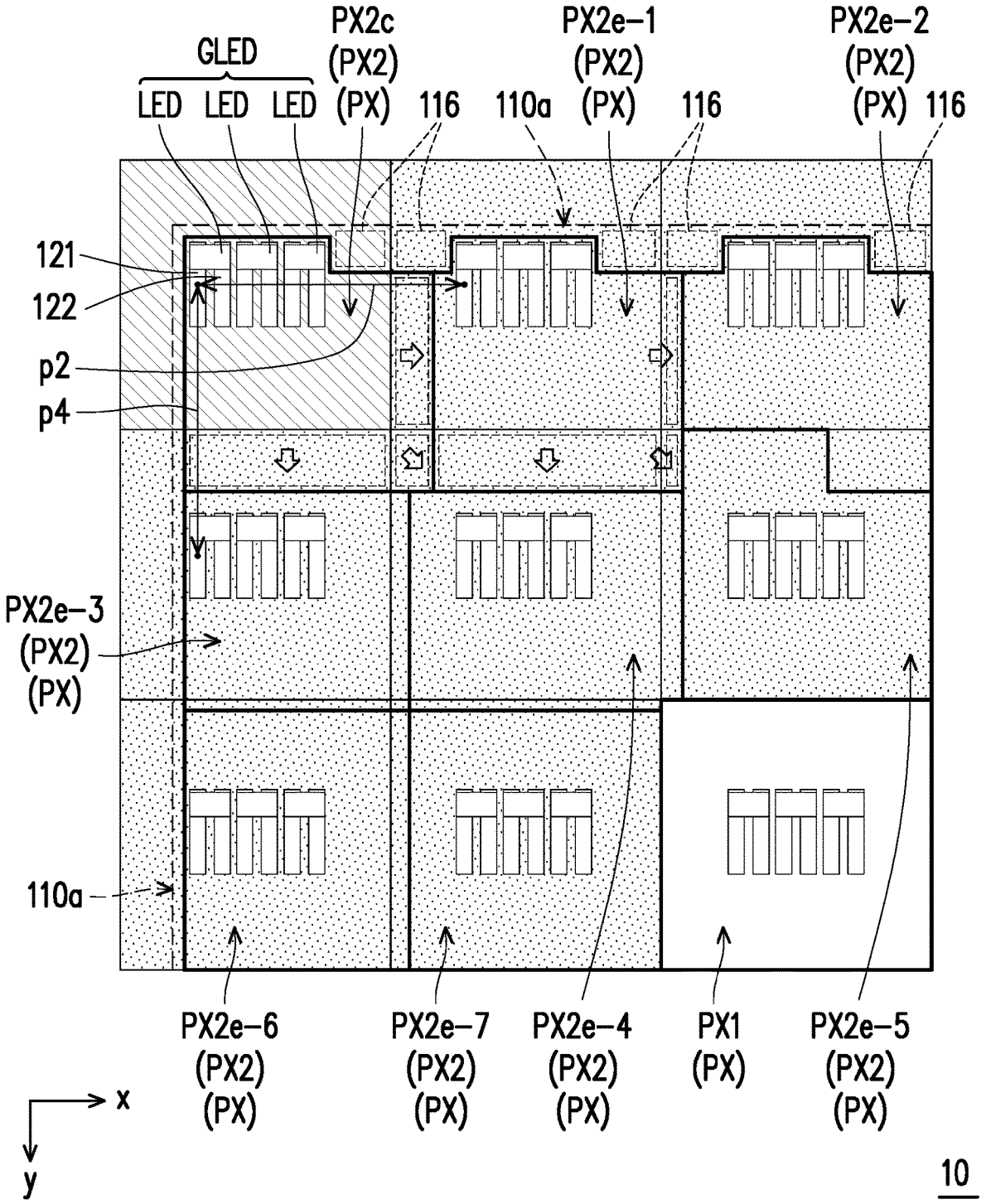
FIG. 2 is a schematic enlarged view showing a part of the display apparatus 10 according to an embodiment of the invention.

FIG. 2 is a schematic enlarged view showing a part of the display apparatus 10 according to an embodiment of the invention. FIG. 2 corresponds to a region R in FIG. 1. FIG. 2 shows a plurality of pads 121 and 122, a plurality of light-emitting diode devices LED, and a side pad region 116 of the substrate 110, and other components of the display apparatus 10 are omitted.

Figure 3:
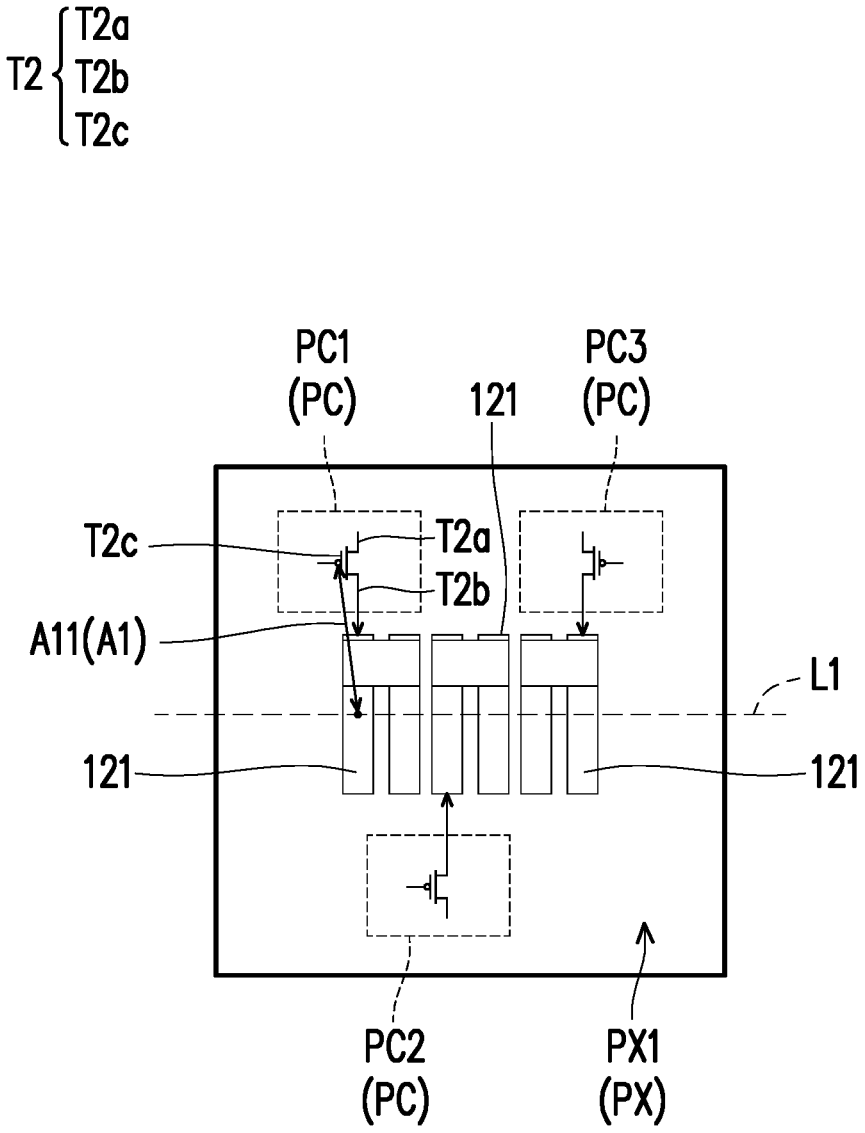
FIG. 3 is a schematic enlarged view showing a standard pixel PX1 of FIG. 2.
Figure 4:
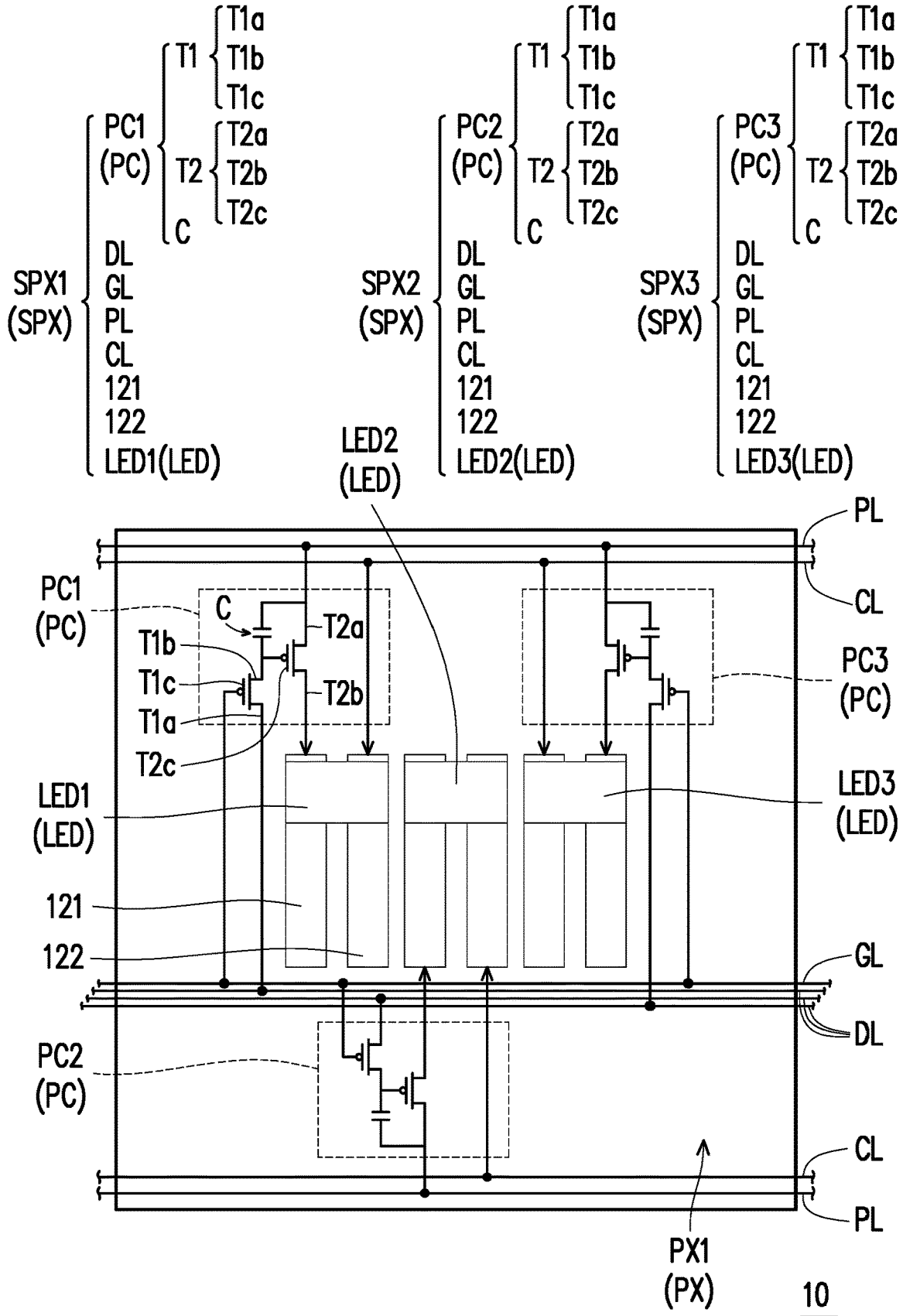
FIG. 4 is a schematic enlarged view showing the standard pixel PX1 of FIG. 3.

FIG. 3 is a schematic enlarged view showing a standard pixel PX1 of FIG. 2. FIG. 4 is a schematic enlarged view showing the standard pixel PX1 of FIG. 3. FIG. 3 shows a second transistor T2 of a pixel driving circuit PC, and other components of the pixel driving circuit PC are omitted.

Figure 5:
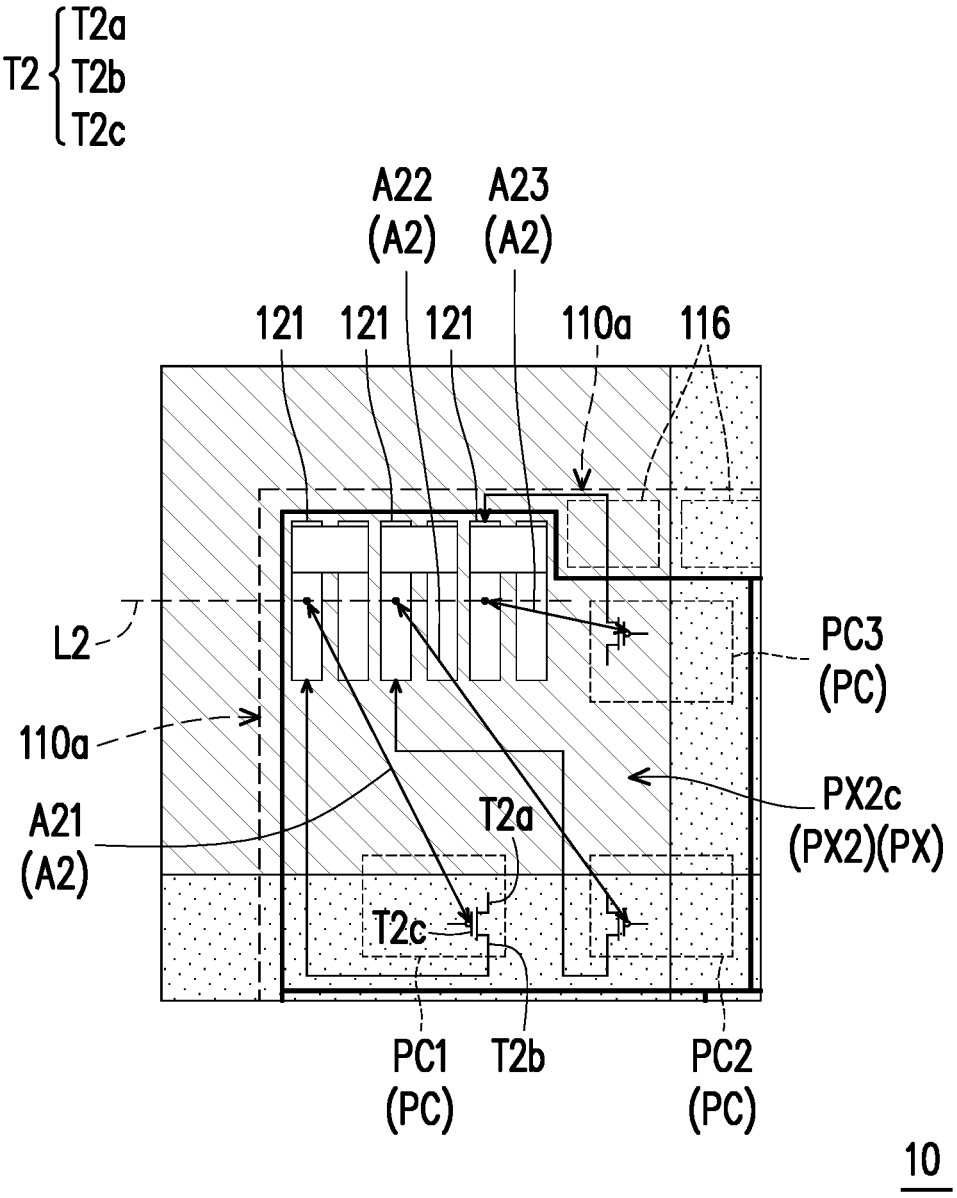
FIG. 5 is a schematic enlarged view showing a corner pixel PX2*c* of FIG. 2.
Figure 6:
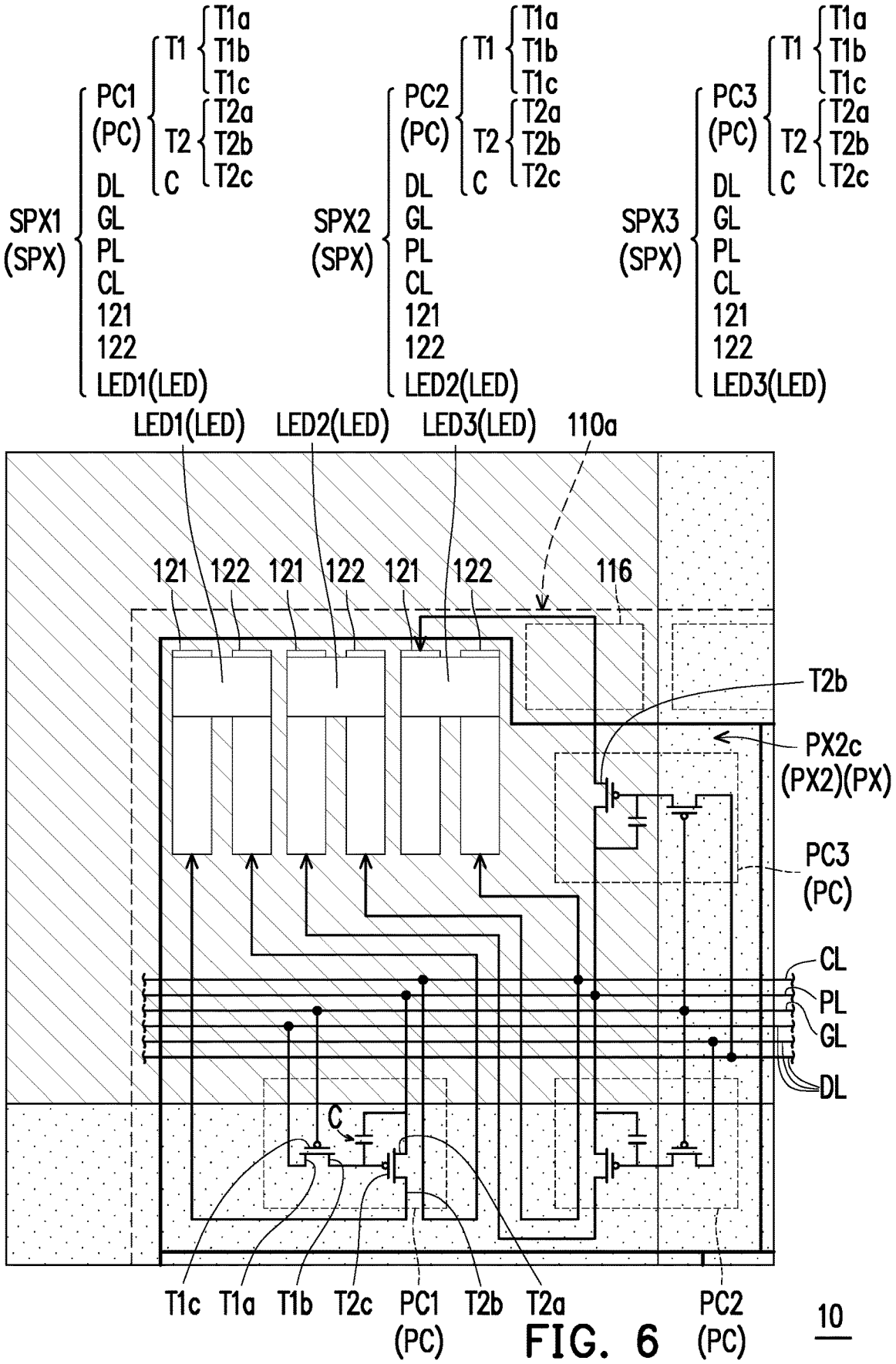
FIG. 6 is a schematic enlarged view showing the corner pixel PX2*c* of FIG. 5.

FIG. 5 is a schematic enlarged view showing a corner pixel PX2*c* of FIG. 2. FIG. 6 is a schematic enlarged view showing the corner pixel PX2*c* of FIG. 5. FIG. 5 shows the second transistor T2 of the pixel driving circuit PC, and other components of the pixel driving circuit PC are omitted.

Figure 7:
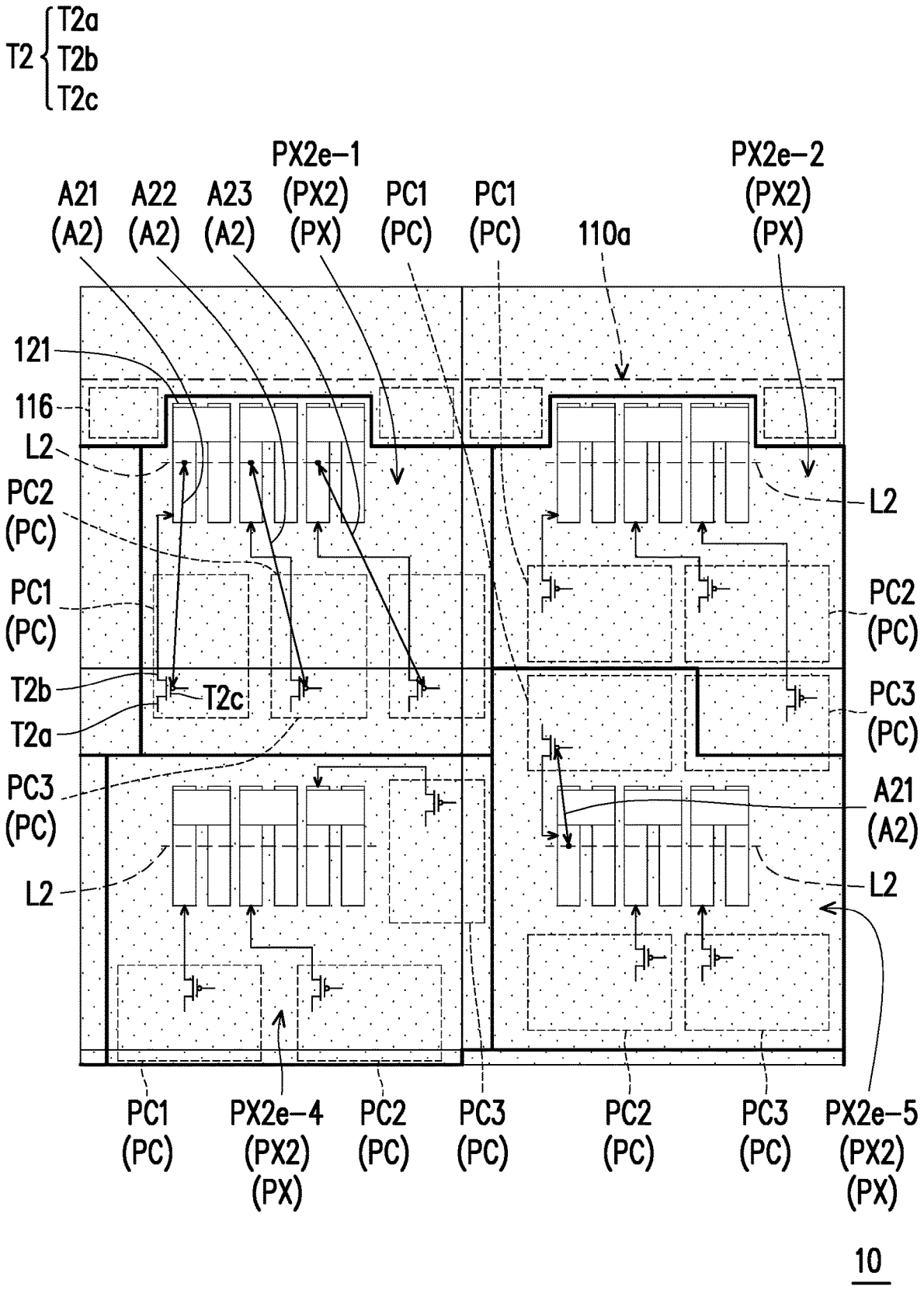
FIG. 7 is a schematic enlarged view showing an edge pixel PX2*e*-1, an edge pixel PX2*e*-2, an edge pixel PX2*e*-4, and an edge pixel PX2*e*-5 of FIG. 2.

FIG. 7 is a schematic enlarged view showing an edge pixel PX2*e*-1, an edge pixel PX2*e*-2, an edge pixel PX2*e*-4, and an edge pixel PX2*e*-5 of FIG. 2. FIG. 7 shows the second transistor T2 of the pixel driving circuit PC, and other components of the pixel driving circuit PC are omitted.

Figure 8:
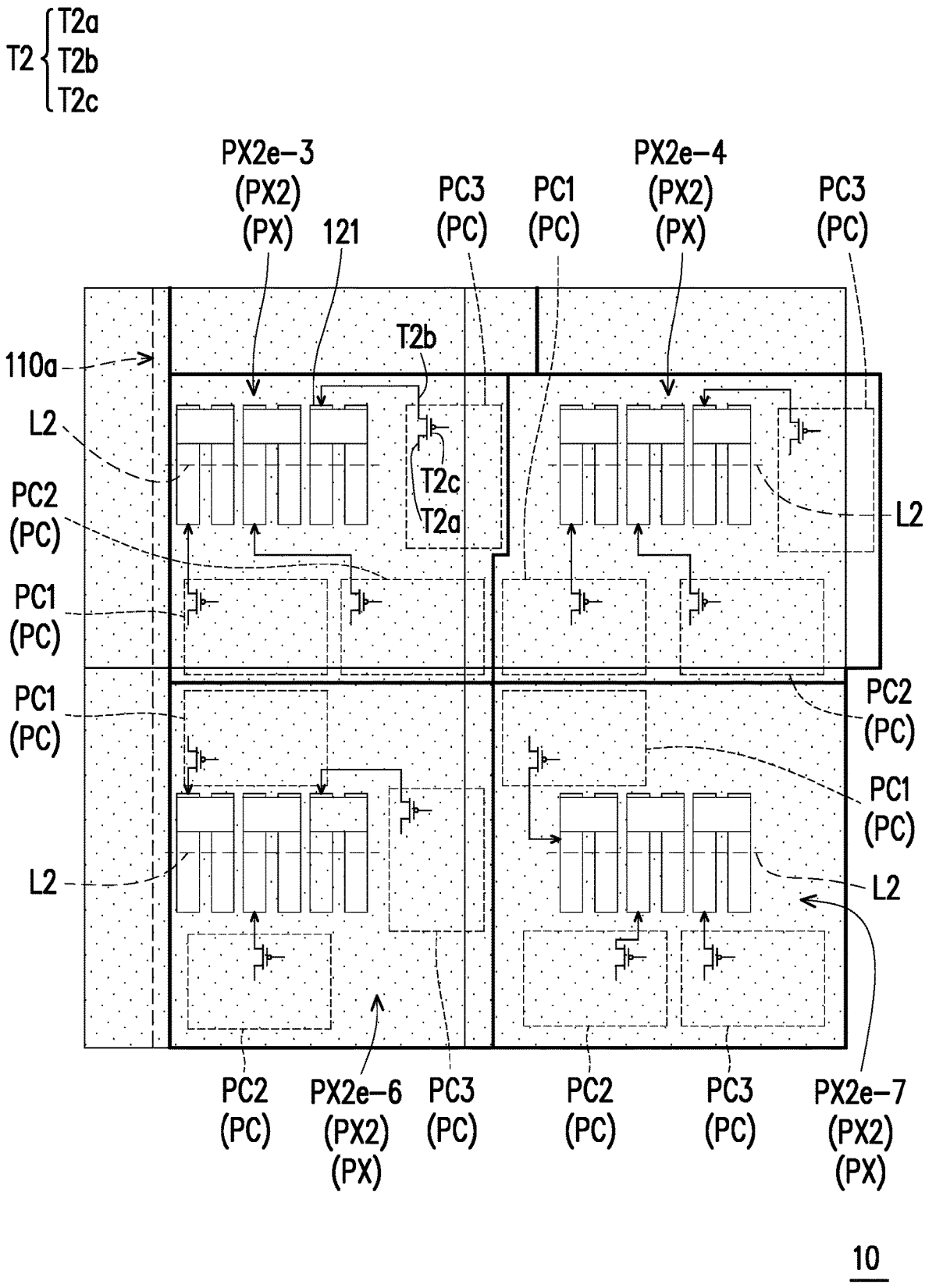
FIG. 8 is a schematic enlarged view showing an edge pixel PX2*e*-3, an edge pixel PX2*e*-4, an edge pixel PX2*e*-6, and an edge pixel PX2*e*-7 of FIG. 2.

FIG. 8 is a schematic enlarged view showing an edge pixel PX2*e*-3, an edge pixel PX2*e*-4, an edge pixel PX2*e*-6, and an edge pixel PX2*e*-7 of FIG. 2. FIG. 8 shows the second transistor T2 of the pixel driving circuit PC, and other components of the pixel driving circuit PC are omitted.

Referring to FIG. 1 and FIG. 2, a display apparatus 10 includes a substrate 110. The substrate 110 is mainly configured to carry the elements of the display apparatus 10. For example, in this embodiment, the material of the substrate 110 may be glass, quartz, an organic polymer, an opaque/reflective material (e.g., wafers, ceramic, or other suitable materials), or other suitable materials.

The substrate 110 has an intermediate region 112 and a peripheral region 114. The peripheral region 114 is located between at least one edge 110*a* and the intermediate region 112 of the substrate 110. For example, in this embodiment, the peripheral region 114 may be located between all edges 110*a* and the intermediate region 112 of the substrate 110, and the peripheral region 114 may be an annular region surrounding the intermediate region 112, but the invention is not limited thereto.

It is noted that the figure shows the substrate 110 which has not been cut from its mother substrate, and the edges 110*a* along which the substrate 110 is cut from the mother substrate are substantially as shown by the broken lines labeled with reference numeral 110*a* in the figure.

The display apparatus 10 includes a plurality of pixels PX disposed on the substrate 110. A plurality of light-emitting diode devices LED of the same pixel PX form a light-emitting diode device group GLED. A plurality of light-emitting diode device groups GLED of a plurality of pixels PX are arranged in an array on the substrate 110. The pixel PX in which the light-emitting diode device group GLED is located in the intermediate region 112 (indicated by a blank pattern) is referred to as a standard pixel PX1. The pixel PX in which the light-emitting diode device group GLED is located in the peripheral region 114 (indicated by a slant line pattern and a dotted pattern) is referred to as a peripheral pixel PX2.

In this embodiment, the plurality of peripheral pixels PX2 include a corner pixel PX2*c* and a plurality of edge pixels PX2*e*-1 to PX2*e*-7. Each corner pixel PX2*c* is disposed by the junction of two edges 110*a* of the substrate 110 (i.e., disposed at the corner; the corner is indicated by the slant line pattern). The plurality of edge pixels PX2*e*-1 to PX2*e*-7 are disposed in a non-corner region by the edges 110*a* of the substrate 110 (indicated by the dotted pattern).

In this embodiment, the plurality of peripheral pixels PX2 (e.g., the corner pixel PX2*c* and the edge pixels PX2*e*-1 to PX2*e*-7) corresponding to two adjacent edges 110*a* of the substrate 110 may be substantially arranged in two rows and two columns. However, the invention is not limited thereto. The numbers of rows and columns formed by the plurality of peripheral pixels PX2 corresponding to two adjacent edges 110*a* of the substrate 110 may be appropriately changed according to the actual requirements. For example, in another embodiment, the numbers of rows and columns formed by the plurality of peripheral pixels PX2 corresponding to two adjacent edges 110*a* of the substrate 110 may also be three rows and three columns.

In addition, in this embodiment, a side pad region 116 may be provided between a row of peripheral pixels PX2 closest to one edge 110*a* of the substrate 110 (e.g., the corner pixel PX2*c*, the edge pixel PX2*e*-1, and the edge pixel PX2*e*-2) and the edge 110*a* of the substrate 110. The substrate 110 has a front surface (i.e., the paper surface of FIG. 1), a rear surface opposite to the front surface, and a sidewall connected between the front surface and the rear surface. The light-emitting diode devices LED are disposed on the front surface of the substrate 110. A side pad (not shown) may be disposed on the side pad region 116 of the front surface of the substrate 110. The side pad is electrically connected to a lead (not shown) located on the sidewall of the substrate 110, and a data line DL, a scan line GL, a power line PL, a common line CL, or other components located on the front surface of the substrate 110 may be electrically connected to fan-out wires (not shown) and/or a chip (not shown) located on the rear surface of the substrate 110 through the side pad and the lead located on the sidewall of the substrate 110.

Referring to FIG. 4, each pixel PX includes a plurality of sub-pixels SPX. In this embodiment, each sub-pixel SPX includes a data line DL, a scan line GL, a power line PL, a common line CL, a pixel driving circuit PC, a pad 121, and a light-emitting diode device LED. The pixel driving circuit PC of each sub-pixel SPX includes a first transistor T1, a second transistor T2, and a capacitor C. A first terminal T1*a* of the first transistor T1 is electrically connected to the data line DL. A control terminal T1*c* of the first transistor T1 is electrically connected to the scan line GL. A second terminal T1*b* of the first transistor T1 is electrically connected to a control terminal T2*c* of the second transistor T2. A first terminal T2*a* of the second transistor T2 is electrically connected to the power line PL. The capacitor C is electrically connected to the second terminal T1*b* of the first transistor T1 and the first terminal T2*a* of the second transistor T2. A second terminal T2*b* of the second transistor T2 is electrically connected to the pad 121.

The first electrode (not shown) of the light-emitting diode device LED is electrically connected to the pad 121. The second electrode (not shown) of the light-emitting diode device LED is electrically connected to a corresponding common line CL. For example, in this embodiment, each sub-pixel SPX may optionally include another pad 122 separated from the pad 121, and the second electrode of the light-emitting diode device LED of each sub-pixel SPX may be electrically connected to the common line CL through the pad 122, but the invention is not limited thereto.

In this embodiment, the light-emitting diode device LED of each sub-pixel SPX is transferred from a growth substrate (not shown) onto the active component substrate including the substrate 110, the data line DL, the scan line GL, the power line PL, the common line CL, the pixel driving circuit PC, and the pad 121 to further form the display apparatus 10. For example, in this embodiment, the light-emitting diode device LED may be formed on a sapphire substrate first, and then transferred onto the pad 121 of the active component substrate. The light-emitting diode device LED may be an inorganic light-emitting diode device such as a micro LED, a mini LED, or an inorganic light emitting diode of another size, but the invention is not limited thereto.

In this embodiment, each pixel PX may include a first sub-pixel SPX1, a second sub-pixel SPX2, and a third sub-pixel SPX3. A light-emitting diode device LED1 of the first sub-pixel SPX1, a light-emitting diode device LED2 of the second sub-pixel SPX2, and a light-emitting diode device LED3 of the third sub-pixel SPX3 are respectively configured to emit a first color light, a second color light, and a third color light, so that the first sub-pixel SPX1, the second sub-pixel SPX2, and the third sub-pixel SPX3 can respectively display a first color, a second color, and a third color. For example, in this embodiment, the first color, the second color, and the third color may respectively be red, green, and blue, but the invention is not limited thereto.

Referring to FIG. 1, FIG. 2, and FIG. 5, in this embodiment, the relative positions of the plurality of pixel driving circuits PC and the plurality of pads 121 of the plurality of sub-pixels SPX of the plurality of standard pixels PX1 may be substantially the same. To realize a narrow-border or even borderless display apparatus 10, the plurality of pixel driving circuits PC of the plurality of sub-pixels SPX of the peripheral pixels PX2 may be disposed toward the inner side of substrate 110, so that the light-emitting diode devices LED of the peripheral pixels PX2 can be as close to the edges 110*a* of the substrate 110 as possible. Therefore, as shown in FIG. 3 and FIG. 5, the relative positions of the plurality of pixel driving circuits PC and the plurality of pads 121 of the standard pixel PX1 are different from the relative positions of the plurality of pixel driving circuits PC and the plurality of pads 121 of the peripheral pixel PX2.

Referring to FIG. 3, FIG. 4, FIG. 5, and FIG. 6, for example, in this embodiment, a first virtual straight line segment L1 (shown in FIG. 3) passes through a plurality of pads 121 of a plurality of sub-pixels SPX of a standard pixel PX1, and a pixel driving circuit PC1 of the first sub-pixel SPX1 of the standard pixel PX1 and a pixel driving circuit PC2 of the second sub-pixel SPX2 of the standard pixel PX1 are respectively disposed on two opposite sides of the first virtual straight line segment L1. A second virtual straight line segment L2 (shown in FIG. 5) passes through a plurality of pads 121 of a plurality of sub-pixels SPX of a peripheral pixel PX2, and the plurality of pixel driving circuits PC1 and PC2 of the first sub-pixel SPX1 and the second sub-pixel SPX2 of the peripheral pixel PX2 are disposed on the same side of the second virtual straight line segment L2.

Referring to FIG. 1, FIG. 2, FIG. 3, FIG. 5, FIG. 7, and FIG. 8, taking the plurality of peripheral pixels PX2 closest to the corner of the substrate 110 (e.g., one corner pixel PX2*c* and a plurality of edge pixels PX2*e*-1, PX2*e*-2, PX2*e*-3, PX2*e*-4, PX2*e*-5, PX2*e*-6, and PX2*e*-7) and one standard pixel PX1 closest to the peripheral region 114 as an example, the plurality of pixel driving circuits PC1 and PC3 of the first sub-pixel SPX1 and the third sub-pixel SPX3 of the standard pixel PX1 (shown in FIG. 3) are disposed on a first side (e.g., the upper side) of the first virtual straight line segment L1, and the pixel driving circuit PC2 of the second sub-pixel SPX2 of the standard pixel PX1 is disposed on a second side (e.g., the lower side) of the first virtual straight line segment L1. The pixel driving circuit PC3 of the third sub-pixel SPX3 of the corner pixel PX2*c* (shown in FIG. 5) is disposed on the second virtual straight line segment L2, and the plurality of pixel driving circuits PC1 and PC2 of the first sub-pixel SPX1 and the second sub-pixel SPX2 of the corner pixel PX2*c* are disposed on the same side (e.g., the lower side) of the second virtual straight line segment L2. The plurality of pixel driving circuits PC1, PC2, and PC3 of the first sub-pixel SPX1, the second sub-pixel SPX2, and the third sub-pixel SPX3 of the edge pixel PX2*e*-1 (shown in FIG. 7) are disposed on the same side (e.g., the lower side) of the second virtual straight line segment L2. The plurality of pixel driving circuits PC1, PC2, and PC3 of the first sub-pixel SPX1, the second sub-pixel SPX2, and the third sub-pixel SPX3 of the edge pixel PX2*e*-2 (shown in FIG. 7) are disposed on the same side (e.g., the lower side) of the second virtual straight line segment L2. The pixel driving circuit PC3 of the third sub-pixel SPX3 of the edge pixel PX2*e*-3 (shown in FIG. 8) is disposed on the second virtual straight line segment L2, and the plurality of pixel driving circuits PC1 and PC2 of the first sub-pixel SPX1 and the second sub-pixel SPX2 of the edge pixel PX2*e*-3 are disposed on the same side (e.g., the lower side) of the second virtual straight line segment L2. The pixel driving circuit PC3 of the third sub-pixel SPX3 of the edge pixel PX2*e*-4 (shown in FIG. 8) is disposed on the second virtual straight line segment L2, and the plurality of pixel driving circuits PC1 and PC2 of the first sub-pixel SPX1 and the second sub-pixel SPX2 of the edge pixel PX2*e*-4 are disposed on the same side (e.g., the lower side) of the second virtual straight line segment L2. The pixel driving circuit PC1 of the first sub-pixel SPX1 of the edge pixel PX2*e*-5 (shown in FIG. 7) is disposed on a first side (e.g., the upper side) of the second virtual straight line segment L2, and the plurality of pixel driving circuits PC2 and PC3 of the second sub-pixel SPX2 and third sub-pixel SPX3 of the edge pixel PX2*e*-5 are disposed on a second side (e.g., the lower side) of the second virtual straight line segment L2. The pixel driving circuit PC1 of the first sub-pixel SPX1 of the edge pixel PX2*e*-6 (shown in FIG. 8) is disposed on the first side (e.g., the upper side) of the second virtual straight line segment L2, the pixel driving circuit PC2 of the second sub-pixel SPX2 of the edge pixel PX2*e*-6 is disposed on the second side (e.g., the lower side) of the second virtual straight line segment L2, and the pixel driving circuit PC3 of the third sub-pixel SPX3 of the edge pixel PX2*e*-6 is disposed on the second virtual straight line segment L2. The pixel driving circuit PC1 of the first sub-pixel SPX1 of the edge pixel PX2*e*-7 (shown in FIG. 8) is disposed on the first side (e.g., the upper side) of the second virtual straight line segment L2, and the plurality of pixel driving circuits PC2 and PC3 of the second sub-pixel SPX2 and third sub-pixel SPX3 of the edge pixel PX2*e*-7 are disposed on the second side (e.g., the lower side) of the second virtual straight line segment L2.

Referring to FIG. 3, a distance A1 is present between the second transistor T2 and the pad 121 of each sub-pixel SPX of each standard pixel PX1. Specifically, in this embodiment, the control terminal T2*c* of the second transistor T2 is the gate of the second transistor T2. The gate of the second transistor T2 refers to a region at which the conductive layer, to which the gate belongs, overlaps with the semiconductor layer (not shown) of the second transistor T2. The distance A1 of each sub-pixel SPX of each standard pixel PX1 may refer to the distance from the geometric center of the gate of the second transistor T2 to the geometric center of its pad 121. Referring to FIG. 5, a distance A2 is present between the second transistor T2 and the pad 121 of each sub-pixel SPX of each peripheral pixel PX2. Specifically, in this embodiment, the distance A2 of each sub-pixel SPX of each peripheral pixel PX2 may refer to the distance from the geometric center of the gate of the second transistor T2 to the geometric center of its pad 121. In other words, the distance A2 of the sub-pixel SPX of the peripheral pixel PX2 located in the peripheral region 114 and the distance A1 of the sub-pixel SPX of the standard pixel PX1 located in the intermediate region 112 are defined in the same manner.

It is noted that one sub-pixel SPX of the standard pixel PX1 and one sub-pixel SPX of the peripheral pixel PX2 are configured to display the same color, and the distance A1 of the one sub-pixel SPX of the standard pixel PX1 is not equal to the distance A2 of the one sub-pixel SPX of the peripheral pixel PX2.

Referring to FIG. 3 and FIG. 5, taking the corner pixel PX2*c* and the standard pixel PX1 as an example, a distance A21 (labeled in FIG. 5) between the second transistor T2 of the pixel driving circuit PC1 of the first sub-pixel SPX1 of the corner pixel PX2*c* and its pad 121 may be greater than a distance A11 (labeled in FIG. 3) between the second transistor T2 of the pixel driving circuit PC1 of the first sub-pixel SPX1 of the standard pixel PX1 and its pad 121.

Referring to FIG. 3 and FIG. 7, taking the standard pixel PX1 and the edge pixel PX2*e*-5 as an example, the distance A21 (labeled in FIG. 7) between the second transistor T2 of the pixel driving circuit PC1 of the first sub-pixel SPX1 of the edge pixel PX2*e*-5 and its pad 121 may be slightly smaller than the distance A11 (labeled in FIG. 3) between the second transistor T2 of the pixel driving circuit PC1 of the first sub-pixel SPX1 of the standard pixel PX1 and the pad 121 of the first sub-pixel SPX1 of the standard pixel PX1.

In this embodiment, the distance A2 between the second transistor T2 of the first sub-pixel SPX1 of a peripheral pixel PX2 close to the edge 110*a* of the substrate 110 and its pad 121 is greater than the distance A2 between the second transistor T2 of the first sub-pixel SPX1 of another peripheral pixel PX2 farther from the edge 110*a* of the substrate 110 and its pad 121. Referring to FIG. 5 and FIG. 7, for example, the corner pixel PX2*c* is closer to the edge 110*a* of the substrate 110 than the edge pixel PX2*e*-1, and the distance A21 from the second transistor T2 of the pixel driving circuit PC1 of the first sub-pixel SPX1 of the corner pixel PX2*c* to its pad 121 is greater than the distance A21 from the second transistor T2 of the pixel driving circuit PC1 of the first sub-pixel SPX1 of the edge pixel PX2*e*-1 to its pad 121.

In this embodiment, the distance A2 between the second transistor T2 of the second sub-pixel SPX2 of a peripheral pixel PX2 close to the edge 110*a* of the substrate 110 and its pad 121 is greater than the distance A2 between the second transistor T2 of the second sub-pixel SPX2 of another peripheral pixel PX2 far from the edge 110*a* of the substrate 110 and its pad 121. Referring to FIG. 5 and FIG. 7, for example, the corner pixel PX2*c* is closer to the edge 110*a* of substrate 110 than the edge pixel PX2*e*-1, and the distance A22 from the second transistor T2 of the pixel driving circuit PC2 of the second sub-pixel SPX2 of the corner pixel PX2*c* to its pad 121 is greater than the distance A22 from the second transistor T2 of the pixel driving circuit PC2 of the second sub-pixel SPX2 of the edge pixel PX2*e*-1 to its pad 121.

In this embodiment, the distance A2 from the second transistor T2 of the third sub-pixel SPX3 of a peripheral pixel PX2 close to the edge 110*a* of the substrate 110 to its pad 121 may be smaller than the distance A2 from the second transistor T2 of the third sub-pixel SPX3 of another peripheral pixel PX2 far from the edge 110*a* of the substrate 110 to its pad 121. Referring to FIG. 5 and FIG. 7, for example, the corner pixel PX2*c* is closer to the edge 110*a* of the substrate 110 than the edge pixel PX2*e*-1, and the distance A23 from the second transistor T2 of the pixel driving circuit PC3 of the third sub-pixel SPX3 of the corner pixel PX2*c* to its pad 121 may be smaller than the distance A23 from the second transistor T2 of the pixel driving circuit PC3 of the third sub-pixel SPX3 of the edge pixel PX2*e*-1 to its pad 121.

In addition, in this embodiment, the relative positions of the plurality of pixel driving circuits PC and the plurality of pads 121 of the standard pixel PX1 are different from the relative positions of the plurality of pixel driving circuits PC and the plurality of pads 121 of the peripheral pixel PX2. However, the plurality of pads 121 of the plurality of first sub-pixels SPX1 of all pixels PX are arranged at the same pitch in a direction x, and the plurality of pads 121 of the plurality of first sub-pixels SPX1 of all pixels PX are also arranged at the same pitch in a direction y, where the direction x and the direction y intersect. In other words, the plurality of pads 121 of the plurality of first sub-pixels SPX1 of the plurality of standard pixels PX1 arranged at a first pitch p1 (labeled in FIG. 1) in the direction x, the plurality of pads 121 of the plurality of first sub-pixels SPX1 of the plurality of peripheral pixels PX2 are arranged at a second pitch p2 (labeled in FIG. 1 and FIG. 2) in the direction x, and the first pitch p1 is equal to the second pitch p2. The plurality of pads 121 of the plurality of first sub-pixels SPX1 of the plurality of standard pixels PX1 are arranged at a third pitch p3 (labeled in FIG. 1) in the direction y, the plurality of pads 121 of the plurality of first sub-pixels SPX1 of the plurality of peripheral pixels PX2 are arranged at a fourth pitch p4 (labeled in FIG. 1 and FIG. 2) in the direction y, and the third pitch p3 is equal to the fourth pitch p4.

In the following embodiment, the reference numerals and part of the description of the foregoing embodiment are applied, where the same reference numerals are used to indicate the same or similar components, and descriptions of the same technical contents are omitted. Reference may be made to the foregoing embodiment for the omitted descriptions, which will not be repeated in following embodiment.

Figure 9:
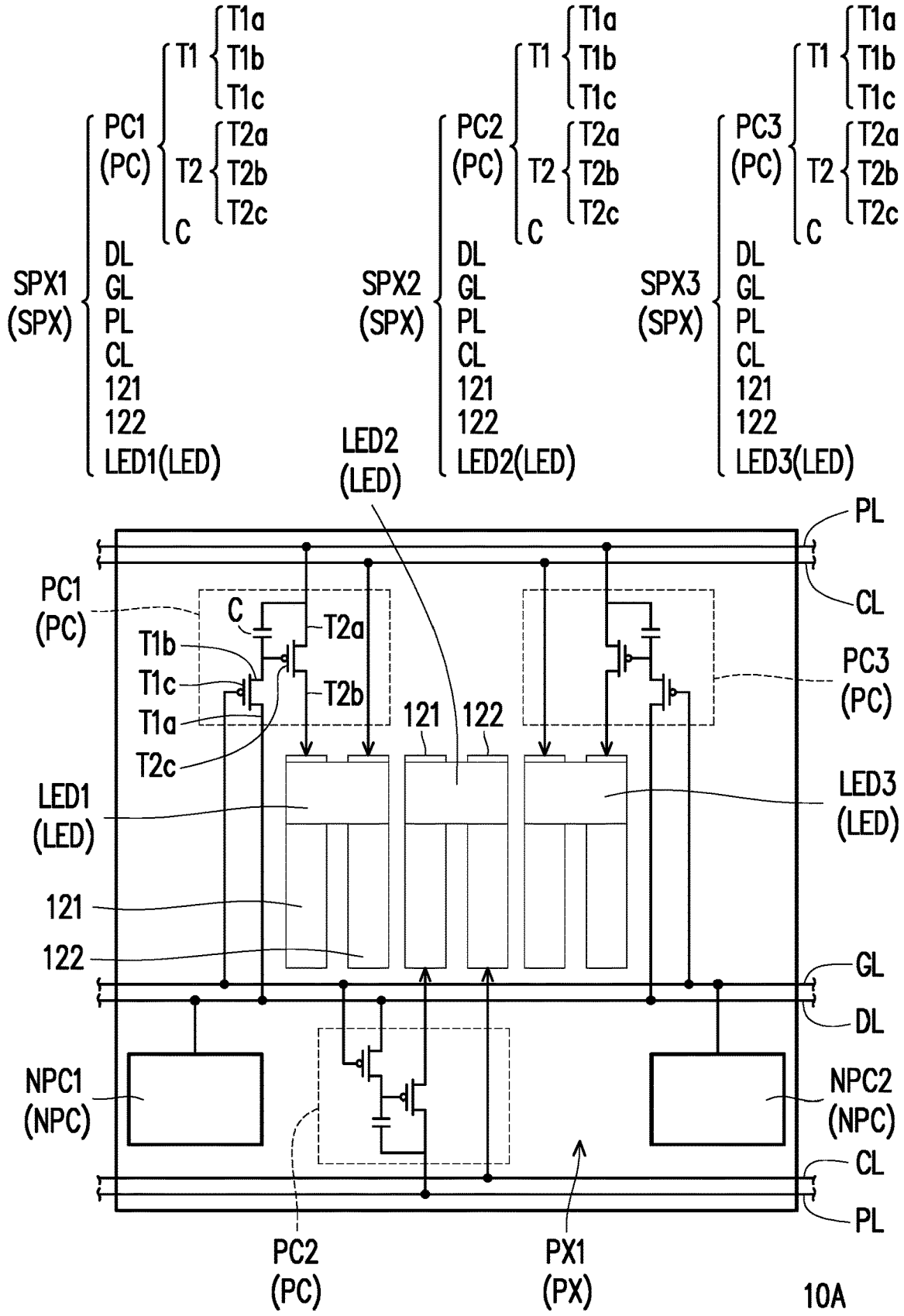
FIG. 9 is a schematic enlarged view showing a standard pixel PX1 of a display apparatus 10A according to another embodiment of the invention.

FIG. 9 is a schematic enlarged view showing a standard pixel PX1 of a display apparatus 10A according to another embodiment of the invention.

Figure 10:
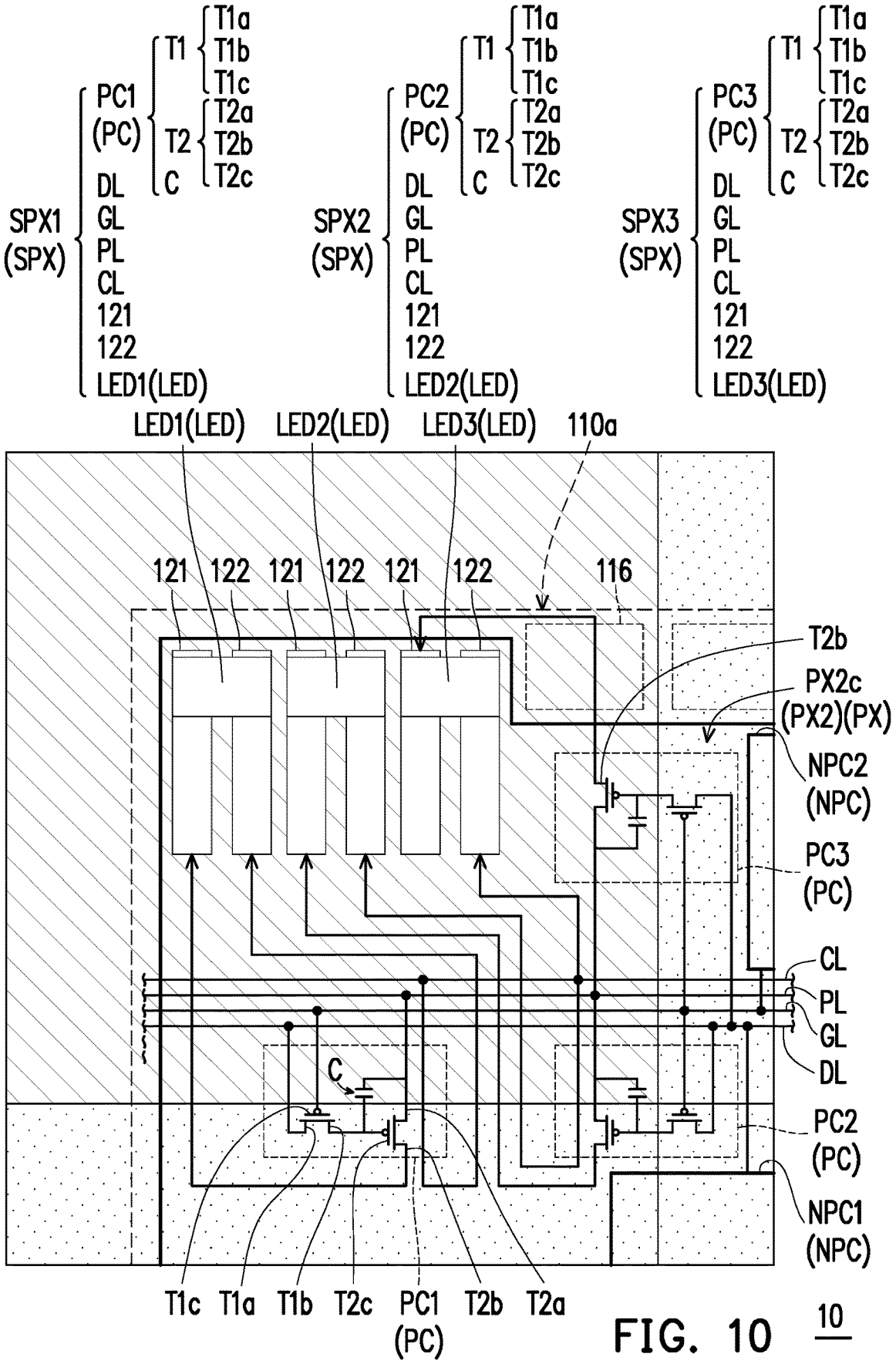
FIG. 10 is a schematic enlarged view showing a peripheral pixel PX2 of the display apparatus 10A according to another embodiment of the invention.

FIG. 10 is a schematic enlarged view showing a peripheral pixel PX2 of the display apparatus 10A according to another embodiment of the invention.

Referring to FIG. 9 and FIG. 10, the display apparatus 10A of this embodiment is similar to the above-described display apparatus 10, and the difference between the two lies in that, in this embodiment, a standard pixel PX1 may further include at least one non-pixel driving circuit NPC, a peripheral pixel PX2 may further include at least one non-pixel driving circuit NPC, and the relative positions of the non-pixel driving circuit NPC and the pad 121 of the standard pixel PX1 are different from the relative positions of the non-pixel driving circuit NPC and the pad 121 of the peripheral pixel PX2.

In this embodiment, the at least one non-pixel driving circuit NPC of the standard pixel PX1 may include a first non-pixel driving circuit NPC1 and a second non-pixel driving circuit NPC2. The first non-pixel driving circuit NPC1 of the standard pixel PX1 may be electrically connected to the same data line DL shared among the plurality of sub-pixels SPX of the standard pixel PX1, and the first non-pixel driving circuit NPC1 of the standard pixel PX1 is, for example, a multiplexer (MUX). The second non-pixel driving circuit NPC2 of the standard pixel PX1 may be electrically connected to the scan line GL of the plurality of sub-pixels SPX of the standard pixel PX1, and the second non-pixel driving circuit NPC2 of the standard pixel PX1 is, for example, an integrated gate driver-on-array (GOA). The at least one non-pixel driving circuit NPC of the peripheral pixel PX2 may include a first non-pixel driving circuit NPC1 and a second non-pixel driving circuit NPC2. The first non-pixel driving circuit NPC1 of the peripheral pixel PX2 may be electrically connected to the same data line DL shared among the plurality of sub-pixels SPX of the peripheral pixel PX2, and the first non-pixel driving circuit NPC1 of the peripheral pixel PX2 is, for example, a multiplexer (MUX). The second non-pixel driving circuit NPC2 of the peripheral pixel PX2 may be electrically connected to the scan line GL of the plurality of sub-pixels SPX of the peripheral pixel PX2, and the second non-pixel driving circuit NPC2 of the peripheral pixel PX2 is, for example, an integrated gate driver-on-array (GOA).

Specifically, in this embodiment, the relative positions of the first non-pixel driving circuit NPC1 and the pad 121 of the standard pixel PX1 are different from the relative positions of the first non-pixel driving circuit NPC1 and the pad 121 of the peripheral pixel PX2. Moreover, the relative positions of the second non-pixel driving circuit NPC2 and the pad 121 of the standard pixel PX1 are different from the relative positions of the second non-pixel driving circuit NPC2 and the pad 121 of the peripheral pixel PX2. For example, the first non-pixel driving circuit NPC1 of the standard pixel PX1 may be disposed on the lower-left side of the pad 121, and the first non-pixel driving circuit NPC1 of the peripheral pixel PX2 may be disposed on the lower-right side of the pad 121. The second non-pixel driving circuit NPC2 of the standard pixel PX1 may be disposed on the lower-right side of the pad 121, and the second non-pixel driving circuit NPC2 of the peripheral pixel PX2 may be disposed on the right side of the pad 121.

In this embodiment, the non-pixel driving circuit NPC is exemplified by a multiplexer (MUX) and an integrated gate driver-on-array (GOA). However, the invention is not limited thereto, and according to other embodiments, the non-pixel driving circuit NPC may include an electrostatic discharge (ESD) circuit, a test circuit, or a combination thereof.

In summary of the above, a display apparatus according to an embodiment of the invention includes a substrate and a plurality of pixels disposed on the substrate. Each pixel includes a plurality of sub-pixels. The substrate has an intermediate region and a peripheral region, where the peripheral region is located between an edge of the substrate and the intermediate region. The plurality of pixels include a plurality of standard pixels disposed in the intermediate region and a plurality of peripheral pixels disposed in the peripheral region. A sub-pixel of a standard pixel and a sub-pixel of a peripheral pixel are configured to display the same color, and a distance from a second transistor of the sub-pixel of the standard pixel to its pad is not equal to a distance from a second transistor of the sub-pixel of the peripheral pixel to its pad. Accordingly, a display apparatus having a narrow border or even no border can be realized.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display apparatus comprising:

a substrate having an intermediate region and a peripheral region, wherein the peripheral region is located between an edge of the substrate and the intermediate region; and a plurality of pixels disposed on the substrate, wherein each of the pixels comprises a plurality of sub-pixels, and each of the sub-pixels comprises:

a pixel driving circuit comprising a first transistor and a second transistor, wherein the first transistor has a first terminal, a second terminal, and a control terminal, the second transistor has a first terminal, a second terminal, and a control terminal, and the second terminal of the first transistor is electrically connected to the control terminal of the second transistor;

a pad electrically connected to the second terminal of the second transistor; and a light-emitting diode device electrically connected to the pad;

wherein the pixels comprise a plurality of standard pixels disposed in the intermediate region and a plurality of peripheral pixels disposed in the peripheral region, and relative positions of a plurality of pixel driving circuits and a plurality of pads of the sub-pixels of the standard pixel are different from relative positions of a plurality of pixel driving circuits and a plurality of pads of the sub-pixels of the peripheral pixel, wherein the sub-pixels of each of the pixels comprise a first sub-pixel and a second sub-pixel, and the first sub-pixel and the second sub-pixel are respectively configured to display a first color and a second color, wherein a first virtual straight line segment passes through a plurality of pads of the sub-pixels of the standard pixel, and a plurality of pixel driving circuits of the first sub-pixel and the second sub-pixel of the standard pixel are respectively disposed on two opposite sides of the first virtual straight line segment, and a second virtual straight line segment passes through a plurality of pads of the sub-pixels of the peripheral pixel, and a plurality of pixel driving circuits of the first sub-pixel and the second sub-pixel of the peripheral pixel are disposed on a same side of the second virtual straight line segment.

2. A display apparatus comprising:

a substrate having an intermediate region and a peripheral region, wherein the peripheral region is located between an edge of the substrate and the intermediate region; and a plurality of pixels disposed on the substrate, wherein each of the pixels comprises a plurality of sub-pixels, and each of the sub-pixels comprises:

a pixel driving circuit comprising a first transistor and a second transistor, wherein the first transistor has a first terminal, a second terminal, and a control terminal, the second transistor has a first terminal, a second terminal, and a control terminal, and the second terminal of the first transistor is electrically connected to the control terminal of the second transistor;

a pad electrically connected to the second terminal of the second transistor; and a light-emitting diode device electrically connected to the pad;

wherein the pixels comprise a plurality of standard pixels disposed in the intermediate region and a plurality of peripheral pixels disposed in the peripheral region, and relative positions of a plurality of pixel driving circuits and a plurality of pads of the sub-pixels of the standard pixel are different from relative positions of a plurality of pixel driving circuits and a plurality of pads of the sub-pixels of the peripheral pixel, wherein each of the sub-pixels further comprises a data line, a scan line, and a power line, the first terminal of the first transistor is electrically connected to the data line, the control terminal of the first transistor is electrically connected to the scan line, and the first terminal of the second transistor is electrically connected to the power line, wherein the standard pixel further comprises a non-pixel driving circuit, the non-pixel driving circuit of the standard pixel is electrically connected to at least one of the data line, the scan line, the power line, the pixel driving circuit, the pad, and the light-emitting diode device of the sub-pixel of the standard pixel, and the peripheral pixel further comprises a non-pixel driving circuit, and the non-pixel driving circuit of the peripheral pixel is electrically connected to at least one of the data line, the scan line, the power line, the pixel driving circuit, the pad, and the light-emitting diode device of the sub-pixel of the peripheral pixel, wherein relative positions of the non-pixel driving circuit of the standard pixel and the pad of the standard pixel are different from relative positions of the non-pixel driving circuit of the peripheral pixel and the pad of the peripheral pixel.

3. The display apparatus according to claim 2, wherein the non-pixel driving circuit includes a multiplexer, an integrated gate driver-on-array, an electrostatic discharge circuit, a test circuit, or a combination thereof.

4. The display apparatus according to claim 1, wherein a plurality of pads of a plurality of first sub-pixels of the standard pixels are arranged at a first pitch in a direction, a plurality of pads of a plurality of first sub-pixels of the peripheral pixels are arranged at a second pitch in the direction, and the first pitch is substantially equal to the second pitch.

* * * * *